US011754316B2

(12) United States Patent
Wylie et al.

(10) Patent No.: US 11,754,316 B2
(45) Date of Patent: Sep. 12, 2023

(54) PROVIDING DOMESTIC HOT WATER FROM CONVENTIONAL RESIDENTIAL SPLIT SYSTEM HEAT PUMPS

(71) Applicant: Villara Corporation, McClellan, CA (US)

(72) Inventors: Rick Wylie, Roseville, CA (US); Robert Radcliff, Folsom, CA (US); Richard Bourne, Davis, CA (US); Mark Beutler, Carmichael, CA (US); James H. Phillips, Sacramento, CA (US); Jim Ramge, Fairfield, CA (US); Felix Ortiz, Sacramento, CA (US); Marc Disalvo, Sacramento, CA (US); Esteban Lopez, Citrus Heights, CA (US); Mike Bettencourt, Walnut Grove, CA (US); Robert Campbell, Sr., Orangevale, CA (US); Marcello Vaca, Sacramento, CA (US); Dujon O. Currington, Sacramento, CA (US)

(73) Assignee: Villara Corporation, McClellan, CA (US)

( * ) Notice: Subject to any disclaimer, the term of this patent is extended or adjusted under 35 U.S.C. 154(b) by 177 days.

(21) Appl. No.: 17/240,134

(22) Filed: Apr. 26, 2021

(65) Prior Publication Data

US 2022/0341628 A1 Oct. 27, 2022

(51) Int. Cl.
*F24D 19/10* (2006.01)
*F24H 4/04* (2006.01)
(Continued)

(52) U.S. Cl.
CPC ..... *F24H 4/04* (2013.01); *F24D 11/0214* (2013.01); *F24D 19/1072* (2013.01); *F24H 9/45* (2022.01);
(Continued)

(58) Field of Classification Search
CPC ..... F24H 4/04; F24H 9/45; F24D 11/0214; F24D 19/1072; F24D 2200/12; F24D 2220/0278; F25B 41/20
See application file for complete search history.

(56) References Cited

U.S. PATENT DOCUMENTS 5,065,585 A 11/1991 Wylie et al.
8,640,475 B2 2/2014 Park et al.
(Continued)

FOREIGN PATENT DOCUMENTS

WO WO-2019124409 A1 * 6/2019 ..... C09K 5/04

OTHER PUBLICATIONS

WO-2019124409-A1 Translation (Year: 2019).*
(Continued)

*Primary Examiner* — David J Teitelbaum
(74) *Attorney, Agent, or Firm* — Mark Protsik; Thomas Schneck

(57) ABSTRACT

In a split system heat pump cooling and heating system, an auxiliary hot water storage tank is provided as an energy storage bank. Two sets of coils run through this storage tank, a first set carrying hot refrigerant from the heat pump to deposit energy and a second set carrying hot potable water to remove energy. Valve and switch matrixes are operated at the heat pump to provide hot potable water from the energy storage bank during both normal space heating and cooling operations of the heat pump.

13 Claims, 11 Drawing Sheets

(51) Int. Cl.

| | |
|---|---|
| ***F24D 11/02*** | (2006.01) |
| ***F25B 41/20*** | (2021.01) |
| ***F24H 9/45*** | (2022.01) |

(52) U.S. Cl.
CPC ..... *F25B 41/20* (2021.01); *F24D 2200/12* (2013.01); *F24D 2220/0278* (2013.01)

(56) References Cited

U.S. PATENT DOCUMENTS

| | | | | |
|---|---|---|---|---|
| 9,476,618 | B2 | 10/2016 | Takenaka et al. | |
| 9,732,998 | B2 | 8/2017 | Leman et al. | |
| 2005/0145370 | A1* | 7/2005 | Merryfull | F28D 7/024 165/104.19 |
| 2010/0319378 | A1 | 12/2010 | Chikami et al. | |
| 2011/0138839 | A1 | 6/2011 | Lee et al. | |
| 2014/0123689 | A1* | 5/2014 | Ellis | F24D 15/04 62/238.7 |
| 2014/0260392 | A1* | 9/2014 | Hawkins | F24D 17/0031 62/238.6 |
| 2015/0330577 | A1* | 11/2015 | Fuller | F17C 13/025 73/290 R |
| 2021/0262676 | A1* | 8/2021 | Baverstock | F24D 17/0068 |

OTHER PUBLICATIONS

USPTO Final Office action for U.S. Appl. No. 12/865,583, filed Jul. 30, 2010 for Hideo Chikami, notification dated Jan. 29, 2014, 10 pages.

* cited by examiner

PROVIDING DOMESTIC HOT WATER FROM CONVENTIONAL RESIDENTIAL SPLIT SYSTEM HEAT PUMPS

TECHNICAL FIELD

The invention pertains to heating, ventilation and air-conditioning systems and, more particularly, to heat removal, storage, and use from electrically driven residential split system heat pump systems.

BACKGROUND ART

In recent years there has been increased emphasis on eliminating residential use of natural gas, a carbon containing fuel. In California, there is proposed legislation that requires all new buildings to be built be carbon-free in energy use. This is because burning natural gas generates one molecule of CO2 for every molecule of methane burned, with CO2 build-up leading to adverse environmental consequences.

For water heating, on-demand electrically powered heat pumps have been developed but the compressor sizes are extremely small (4200-5000 BTUh). This makes recovery times extremely long, in the range of 7 hours or more if the tank has been fully exhausted. Solutions to the long recovery time come with a very costly energy-bill premium, through increasing the heating setpoint to ~135 degrees, or by use of electric resistance supplemental heating elements that offset the energy efficiency benefits of the heat pump.

For many years, electrical residential air conditioning units have been known. See U.S. Pat. No. 5,065,585 to Wylie et al. entitled, System for Cooling the Interior of a Building. In more recently developed heat pump systems for residences, components are split between those inside of a residence and those outside, known as a split system. Usual operation of a standard prior art heat pump split system in a cooling mode of operation is described with reference to FIG. 1.

In FIG. 1, a residence 101 has a conventional prior art split system heat pump that includes an outdoor unit 103 and indoor fancoil 102 that includes an indoor fan 107 and the indoor coil 106, a return air duct system 105, supply air duct system 104, and thermostat 114. In a residence cooling mode of operation the thermostat 114 is set to call for cooling. In that situation a compressor 109 in outdoor unit 103, an outdoor fan 111, the indoor fan 107, and a refrigerant reversing valve 112 are all energized. Liquid refrigerant from the bottom of the outdoor coil 110 is pumped into the residence 101 and into the fancoil 102 via liquid line refrigerant pipe 108, where it passes through the expansion valve 113 where its pressure and temperature are dropped before entering indoor coil 106. As the cooled and vaporizing refrigerant flows through indoor coil 106 it cools the residence 101 with air that is being drawn through the return air duct 105 by the indoor fan 107, exiting through the supply air duct system 104. The incoming return air from the residence 101 is typically cooled by about 20 degrees Fahrenheit, until the thermostat 114 set point is attained.

As the refrigerant flows through the indoor coil 106 absorbing the heat from within the residence, the refrigerant fully vaporizes, and the relatively cool refrigerant vapor exits the indoor coil 106 via the vapor line 117, entering into the reversing valve 112. In its energized state the reversing valve directs this vapor into the compressor 109, where its pressure is significantly increased, thereby increasing its temperature to a point that is hotter than the ambient air that the outdoor coil 110 has within. The compressor 109 pumps this heated and pressurized refrigerant through another port in reversing valve 112, directing this hot gas to the outdoor coil 110. As the hot refrigerant circulates through the tubes within outdoor coil 110, the outdoor air that is pulled through the coil by means of outdoor fan 111 cools the refrigerant to the point that it changes state back to a liquid refrigerant, where it ultimately enters the liquid line pipe 108 to start the cycle over again. This cycle continues until the thermostat 114 set point is attained, wherein the compressor 109, outdoor fan 111, reversing valve 112, and indoor fan 107 are all de-energized.

When the thermostat 114 calls for heating, the compressor 109, the outdoor fan 111, and the indoor fan 107, are all energized, but refrigerant reversing valve 112 is not energized. This causes the flow of refrigerant to be reversed, as compared to a cooling cycle described above. The indoor coil 106 becomes the condensing coil, transferring heat to the indoor air raising its temperature. The refrigerant is then pumped through refrigerant line 108 to an expansion valve 115 in outdoor unit 103, reducing the pressure and temperature of the refrigerant as it moves through the outdoor coil 110. This process allows the refrigerant to absorb heat from outdoors, before passing through the reversing valve 112 to the compressor 109, where it is pressurized to a high-pressure vapor state that is pumped to the indoor coil 106 via the refrigerant vapor line 117, continuing the refrigerant cycle. When thermostat 114 is satisfied, the system shuts down.

The above operations explain the two normal operating modes of the split system residential heat pump, namely space cooling and space heating. There is also a third normal operating mode known as the defrost cycle, which occurs within a normal space heating operation.

When outdoor temperatures are lower than about 50 degrees F., during space heating operation ice will slowly form on the outdoor coil 110, which reduces airflow across the coil thereby reducing heating capacity. All traditional heat pumps incorporate a "defrost control" which detects this condition, and periodically initiates "defrost mode" in order to de-ice the coil to allow full airflow across the coil. This is usually initiated in time intervals (around 90 minutes), when the unit senses temperature conditions that will cause a build-up of ice on the outdoor coil 110.

When the defrost control initiates defrost, the refrigerant valve 112 is energized, technically putting the system back in "space cooling mode". This mode allows the system to withdraw heat from the residence 101 interior space and transmit that heat via the refrigerant to the outdoor unit's coil 110, causing the ice to melt. During this time the outdoor fan 111 is de-energized to allow this hot refrigerant gas to more quickly deice the coil 110. This defrost cycle typically lasts around 5 minutes, during which time the system is essentially cooling the indoor space at a time when the thermostat 114 is calling for heating. During this time the indoor occupant can be feeling ~50 degree F. air blowing into the space, instead of the normal 100 degree F. heated air typically experienced.

To reduce the amount of discomfort that this operation can occupants, the indoor fancoil 102 typically incorporates a high wattage (5000 to 7500 watts) electrical heat strip that essentially reheats the air flowing into the home after it has been cooled by the refrigerant, so that the incoming air to the residence is ~65 degrees F., instead of 50 degrees F. While this does reduce the discomfort somewhat, it greatly increases the amount of energy that the system is consuming in its normal operations.

An object of the invention was to find a way to use conventional heavy duty residential split system heat pump cooling and heating units, as described above, to provide residential hot water.

SUMMARY OF DISCLOSURE

The above object has been achieved by modifying residential split system heat pump cooling and heating units, such as those manufactured by Carrier Corporation, by adding an atmospheric pressure water storage tank ("Hot-Tank" herein) that has integral refrigerant and potable water coils. The coils are operative using a refrigerant valve matrix and a switch matrix in order to use the heat pump system to provide residential hot water needs, in addition to the normal space heating and cooling functions described above. In other words, residential hot water is "stolen" from the heat pump for the Hot Tank using the valve and switch matrixes. The end result is an improved integrated hot water supply heat pump system that has several advantages.

First, the improved system provides energy efficient hot water through the use of the heat pump heating process and does so in a fraction of the time that it takes major-market hot water heat pumps to provide the same quantity of hot water. This results in the reduction or elimination of residence occupants waiting to take showers or baths, while a water heater reheats water.

Secondly, an increased heating capacity eliminates the need to add electric resistance heating elements to a hot water heater, as is the common approach for traditional hot water heat pumps. Such units use the resistance heating elements to reduce the waiting time noted above, but in doing so drive up the cost of electric energy while still providing slow water heat recovery times. Electrical resistance elements use 2-4 times as much energy as a compressor in a split system heat pump system of the type described above.

Thirdly, the improved system adds to comfort provided by a conventional split system heat pump by extracting heat from the Hot-Tank during a defrost mode, rather than by extracting heat from the interior space of the home at a time when the home needs heat. This results in markedly improved comfort for the residential occupants.

Fourthly, the improved system provides cooling for the interior of a residence during warm summer months, while transferring this heat directly to the Hot-Tank. This effectively provides free hot water heating during many of the summer cooling season hours, increasing the overall energy efficiency of the system.

DESCRIPTION OF THE INVENTION

Figure 2:
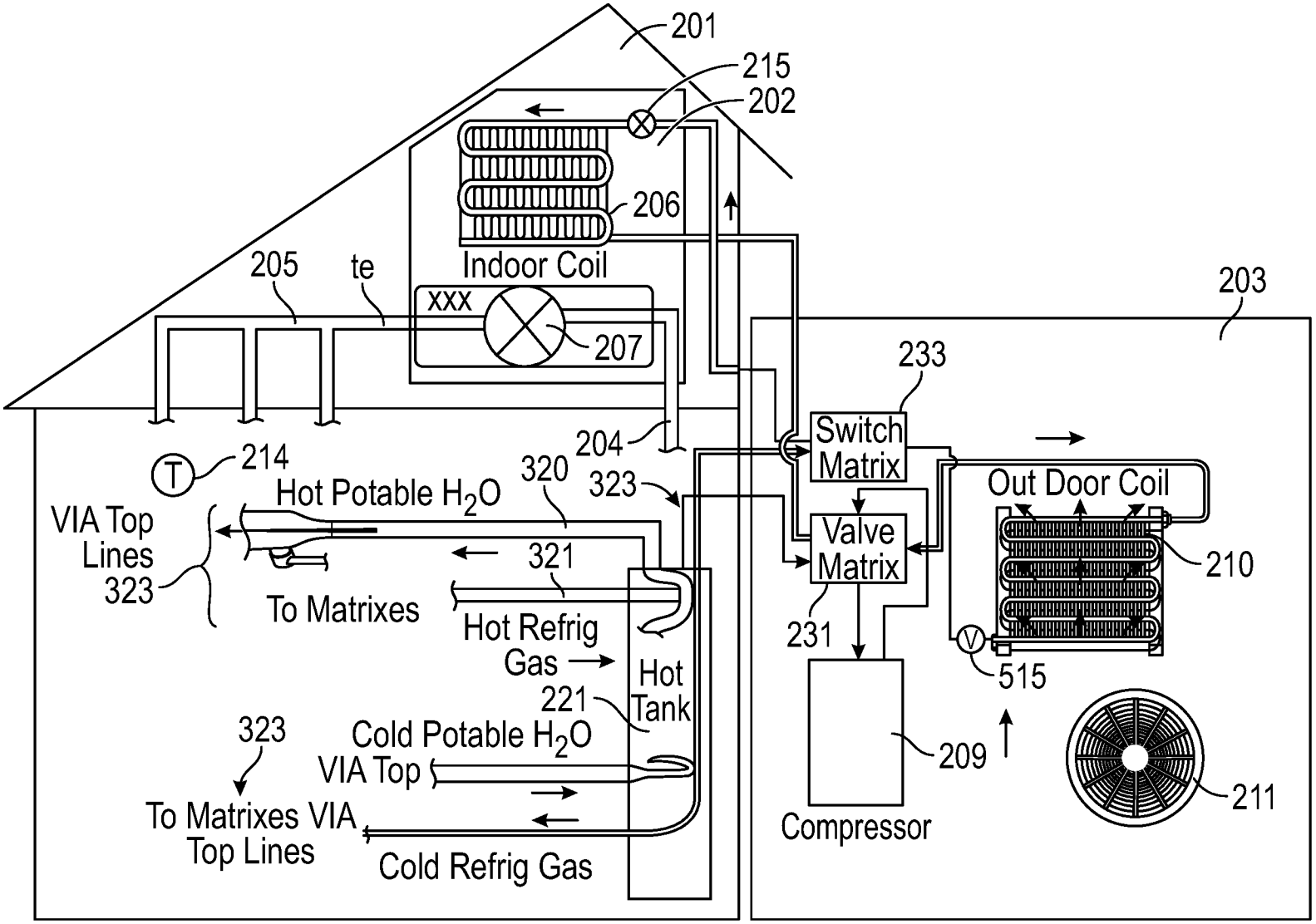
FIG. 2 is a plan diagram of an improved residential split system heat pump with a Hot Tank of the invention.

In FIG. 2, a residence 201 has the improved split system heat pump system of the invention that includes an outdoor unit 203 and indoor fancoil 202 that includes an indoor fan 207 and the indoor coil 206, a return air duct system 205, supply air duct system 204, and thermostat 214.

A Hot Tank 221, described more fully below, is situated in a closet or garage or other space. The hot tank has two spaced apart intertwined coils 320 and 321 that extend from the top of the Hot Tank 221 to near the bottom thereof. A first of the two coils 320 is used for potable water while the second of the two coils 321 is a refrigerant coil. The two coils terminate in four coil input and output lines 323, two for each coil at the top of Hot Tank 221. The refrigerant lines 323 are interconnected to a valve matrix 231 and a switch matrix 233 that are also connected to compressor 209 and the indoor coil 206 through expansion valve 215 and the outdoor coil 210.

Figure 3:
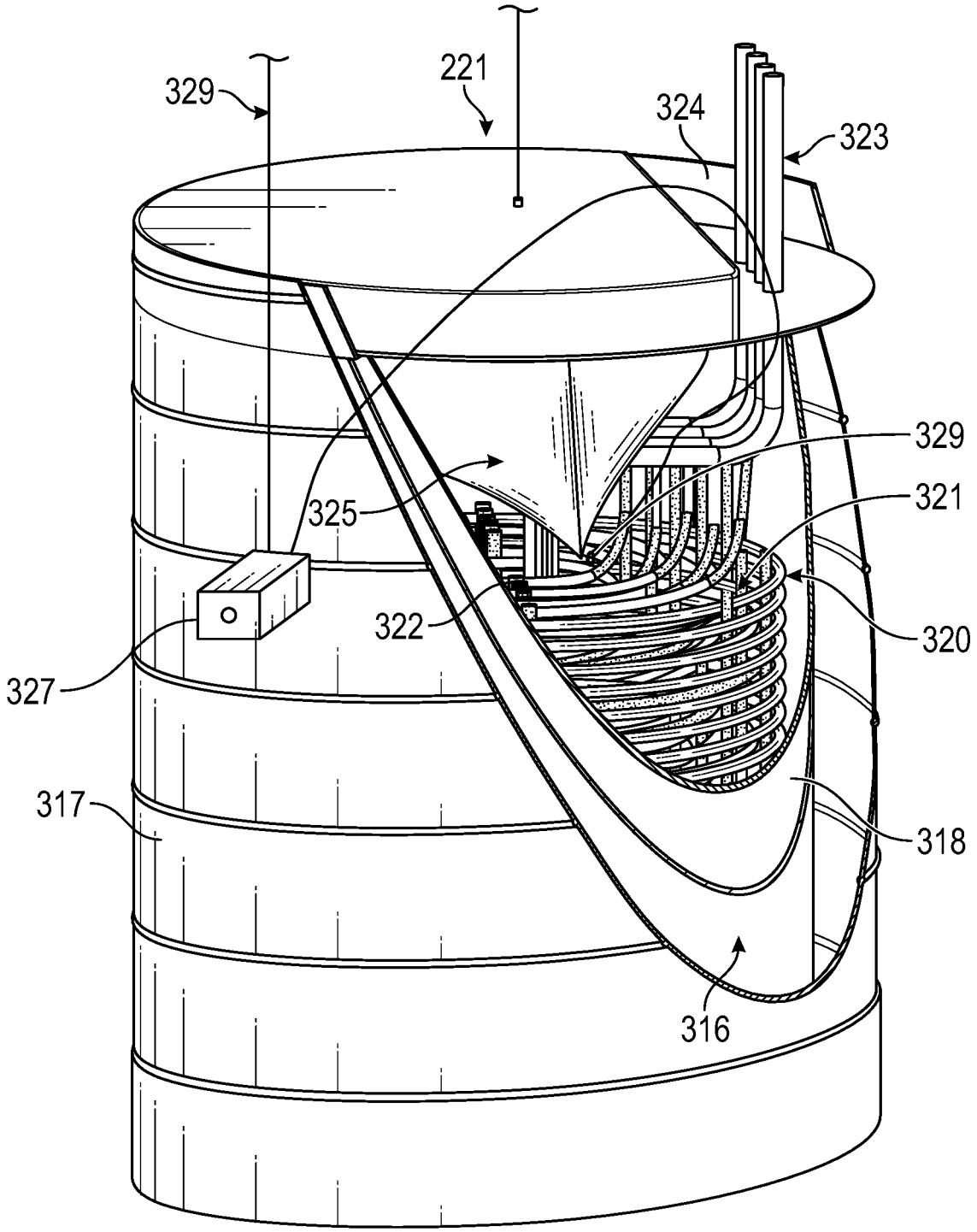
FIG. 3 is a cut-away elevation view of the Hot-Tank shown in FIG. 2.

With reference to FIG. 3 an exemplary 64-gallon HotTank hot water storage vessel 221 made of a galvanized spiral steel outer shell 317 has a molded plastic liner 318 that contains water being heated as a thermal energy storage bank. Poured between these two tank layers 317 and 318 is closed-cell foam insulation 316, which resists the flow of heat from the heated water to the environment where the HotTank 221 is located. Within the HotTank is a spiral assembly of parallel copper tube potable water coils 320 and a spiral assembly of parallel aluminum or copper tube refrigerant coils 321, both coil assemblies wound together with non-metallic spacers 322 between them to allow ample water circulation space and to also prevent direct electrical transfer between the copper and aluminum coil assemblies.

Both coils 320 and 321 exit the HotTank 221 through a portion of a plastic removable lid 324 via 4 upright tubing sections 323, for final connection to the residence potable water system and refrigerant tubing system. Mounted within the plastic lid assembly 324 is a polyethylene expandable bladder 325, which expands and contracts within the Hot-Tank 221 as the water in the tank expands and contracts due to the heating or cooling of the water during operation of the system. An adjustable thermostat 327 is mounted to the exterior of the HotTank 221, with a temperature sensor 329 located within the water being heated with a low voltage connection 329 between thermostat 327 to a controller described below.

Figure 4:
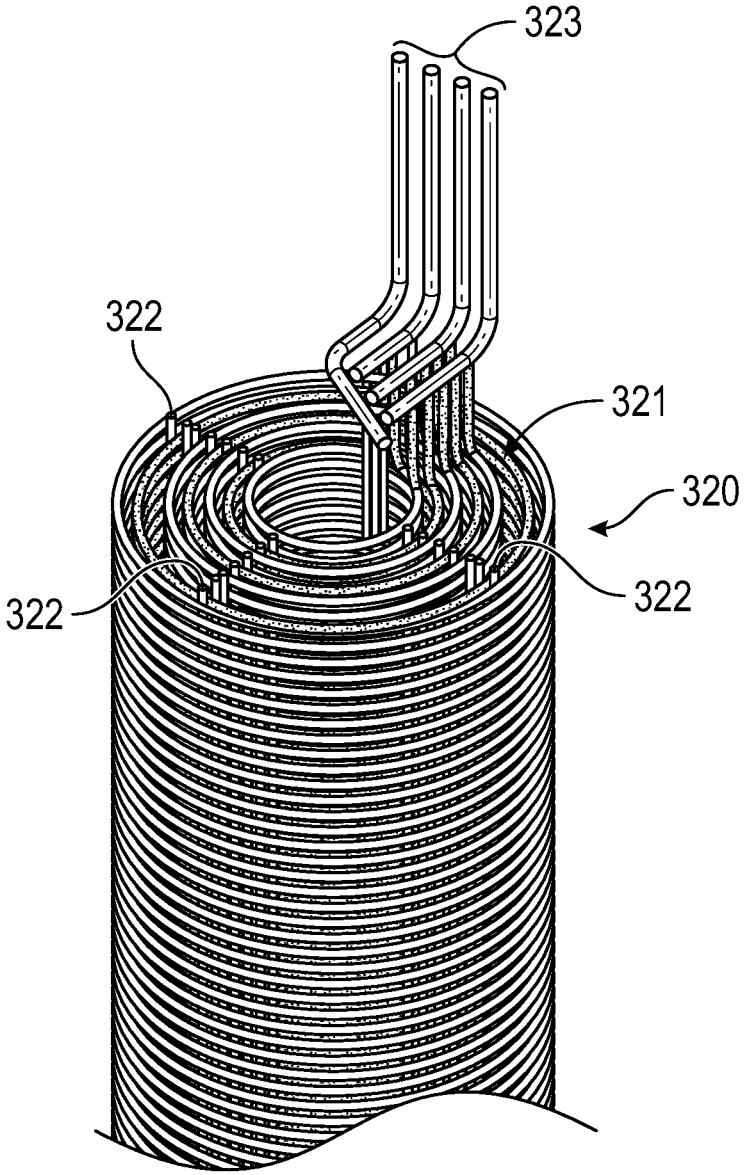
FIG. 4 is a perspective view of a dual-coil assembly in the Hot Tank of FIG. 3.

In FIG. 4 the spiral coil assemblies 320 and 321 are shown to be intertwined yet separated by spacers 322. The four upright tubing sections 323 bring water and refrigerant in and out of the two coils with two of the tubing sections feeding the tops of two coils and the other two tubing sections running up from the bottom of the intertwined coils.

Figure 5:
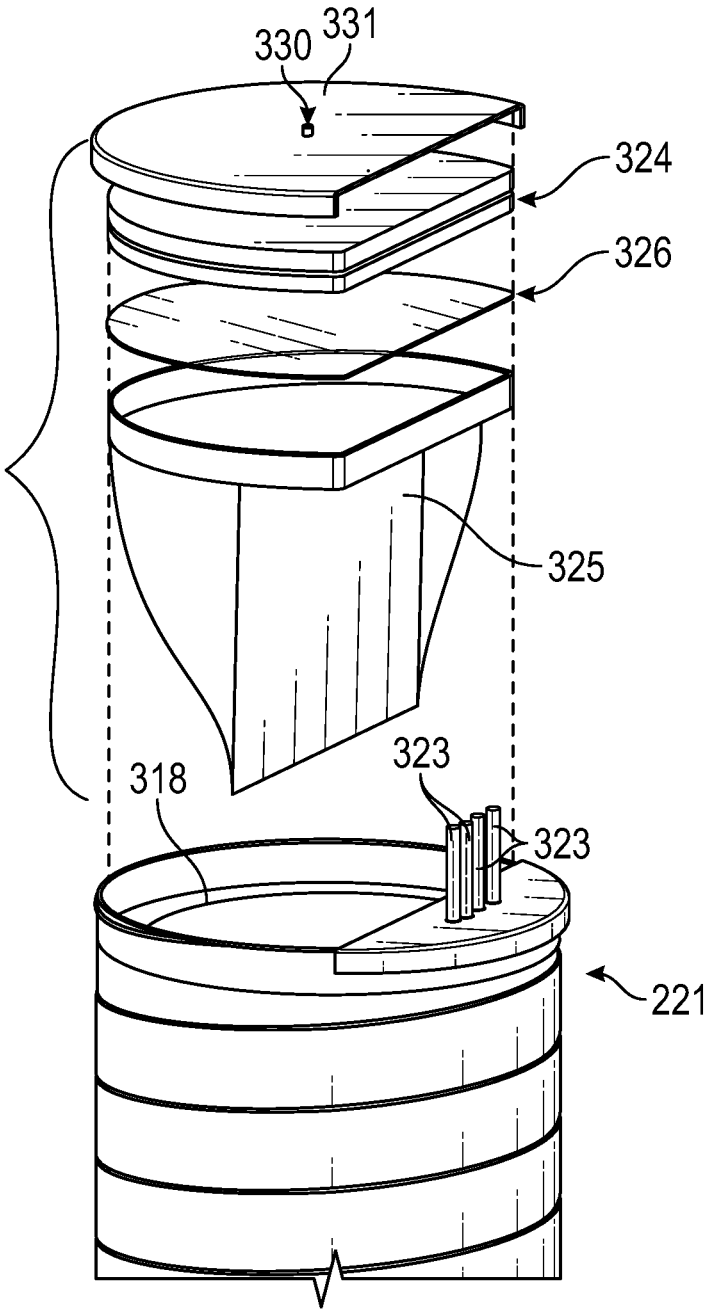
FIG. 5 is an exploded view of a Hot-Tank lid and heat-expansion bag assembly for the Hot Tank of FIG. 3.
Figure 6:
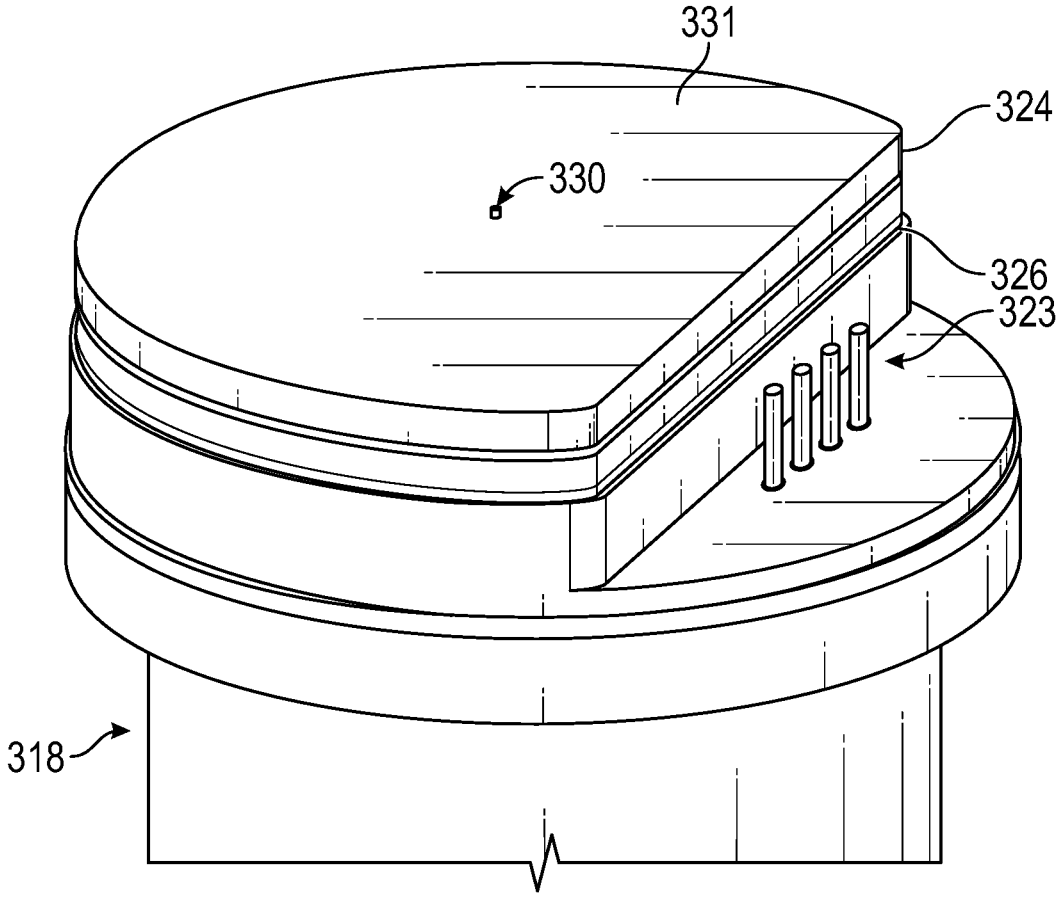
FIG. 6 is a close-up view of a liner and cap for the Hot Tank shown in FIG. 3.

In FIGS. 5 and 6, considered with FIG. 3, HotTank lid 324 has an insulative shield 331 with a central air hole 330 above liner cap 324 and expandable bladder 325 with an o-ring gasket 326 that secures the bladder polyethylene bag 325 to the rotomold liner cap 324 and ultimately seals it against the rotomold tank liner 318 when inserted. Rotomold cap 324, with its attached expandable bag 325 is removed from HotTank 221 to allow filling of HotTank 221 with clean potable water, along with a chemical solution that prohibits mold and coil scaling. When the HotTank 221 is properly filled with water, expandable bag 325 is inflated with air via air inlet hole 330, and rotomold cap 324 is reinstalled. The gasket 326 seals the cap 324 to the rotomold liner 318, preventing water vapors from escaping the HotTank 211. This prevents evaporation of water stored in the HotTank.

During system operation hot refrigerant gas circulating through coil 321 heats the stored water within the HotTank 221, and as the water heats it expands. The expandable bag 325 will collapse upwards towards cap 324, preventing the HotTank from pressurizing, while also preventing air and water vapors from escaping the HotTank. This expansion and contraction control function protects the tank from excessive pressurization, while maintaining the HotTank water level due to the prevention of evaporation.

The stored water within the HotTank will be heated from the Hot refrigerant gas until it reaches the thermostat 327 setpoint (typically 125 degrees F.), at which point the Thermostat 327 sends a signal to the system controller to shut off the hot gas flow from the heat pump. Potable water within the water coil 320 receives heat from the 125 degree water solution within the HotTank 221, so when the home occupant turns on a hot water faucet, she will receive water that has been heated in the HotTank. As the hot water faucet continues to flow, cold water enters the bottom of the water coil 320, and is heated as it spirals up through the coils towards the top of the HotTank. The large reservoir of water, 64 gallons in the example herein, maintains sufficient thermal energy such that the residential occupant can receive an ample supply of hot water.

As cold water removes heat from the stored water within the HotTank, the temperature sensor reports along line 329 the dropping temperature to the thermostat 327, and when the temperature drops to the minimum temperature point, for example 110 degrees F., the thermostat 327 sends a call to the system controller to reinitiate hot-gas refrigerant flow to the refrigerant coil 321. Hot gas enters at the top of coil 321, and spirals down the coil towards the bottom of the tank, giving up heat and condensing to a sub-cooled liquid before returning to the switch matrixes of the heat pump system.

Because the hot gas refrigerant enters at the top of the tank, and the incoming cold water enters at the bottom of the tank, the tank maintains a level of heat stratification that improves the overall system performance. The very top of the HotTank 221 will be approximately 135 degrees F., while the bottom of the tank will be approximately 110 degrees F. This improves the efficiency of the refrigerant condensation process, and it improves the efficiency of the heat exchange in the water coil 320, which helps maintain a more consistent hot water temperature for the home occupants.

The water coil 320 has its spiral tubes wound such that there are tighter windings leading to more length of tubing towards the top of the HotTank where temperatures are hotter, with less length towards the bottom of the tank where the temperature differential between the incoming cold water usually about 60 degrees F. and the bottom-of-tank temperature, typically about 110 degrees F. is greater, allowing for efficient heat transfer with less tubing length. This stratified heat zone design feature not only increases the efficiency of the coil heat exchange process but also increases the natural heat stratification in the HotTank.

The refrigerant coil 321 has its spiral windings spaced less tightly at the top such that there is less tubing length towards the top of the HotTank where temperatures are hotter, with greater length towards the bottom of the tank where temperature differential between the incoming refrigerant and the bottom-of-tank temperature is less. This is opposite of the water coil 320 noted above, which again helps increase the HotTank stratification and improves the overall coil efficiency of the refrigerant coil 321.

System Operation

FIGS. 7-11 all show operation of the switch matrix 233 and valve matrix 231 first illustrated in FIG. 2. The matrixes allow the refrigerant to be redirected as required to facilitate five distinct operating modes explained below, in lieu of the normal three operating modes of the traditional split system heat pump.

Figure 1:
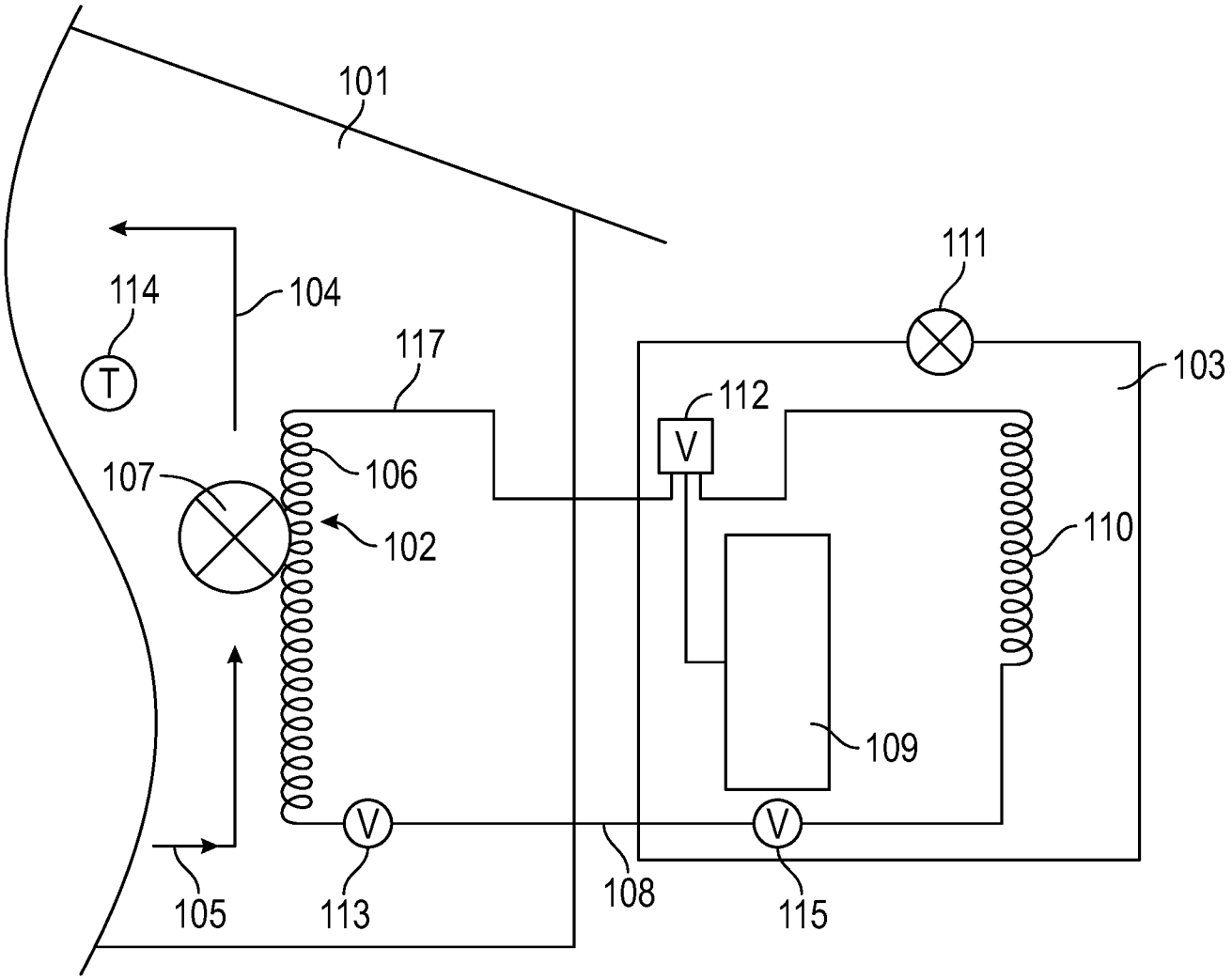
FIG. 1 (Prior Art)
FIG. 1 is a plan diagram of a prior art residential split system heat pump.

In FIGS. 7-12 reversing valve arrays 401, 402, and 403 in valve matrix 231 replaces valve 112 in FIG. 1, redirecting the incoming and exhausting refrigerant gas into the compressor 209 as required by the 5 different operating modes. The valve matrix configuration is advantageous because it uses standard reversing valves that are much less expensive than a custom multi-valve port option. The valve matrix is further advantageous because it facilitates the draw-down of refrigerant in the non-operative coils within the system, thereby utilizing the full refrigerant charge for the operating coils only. This is an important refrigerant-charge management scheme that is an essential enabler of the five operating modes.

The valve matrix 231 is augmented by a switch matrix 233 that uses an array of liquid-line solenoid valves 501, 502, and 503, with a corresponding check-valve arrays 511, 512, and 513 that in combination act as switches to augment valve matrix 231. The arrays of standard liquid line solenoids and check-valves, acting as switches, direct the flow of liquid refrigerant as needed to command the five different operating modes of the invention in a very cost-effective manner as compared to a custom multi-port liquid line valve. The use of these valve and switch matrixes provides the ability to support the piping that services the HotTank 221 with hot refrigerant vapor along pipe 415 and refrigerant liquid pipe 412. The outdoor unit 203 retains the original refrigerant piping that serves the air handler and fan coil 202. This piping is the refrigerant vapor line 424 and the refrigerant liquid pipe 423.

The system controller 430 is a logic device controller that can allow a single conventional split heat pump HVAC system to be operated by multiple thermostats. The controller 430 controls the valve matrix and switch matrix that drives the wiring and piping that involves all of the major components, including fancoil 202, heat pump 203, HotTank 221, air dampers and thermostats and ancillary devices including logic required to respond to the HotTank thermostat 27 and to properly sequence the operation of the custom valve matrix with reversing valves and the switch matrix with a liquid line solenoid valve array. This logic includes arbitration between the five operation modes designed to optimize the performance and reliability of the system, and to prioritize between conflicting calls among the operating modes.

Figure 7:
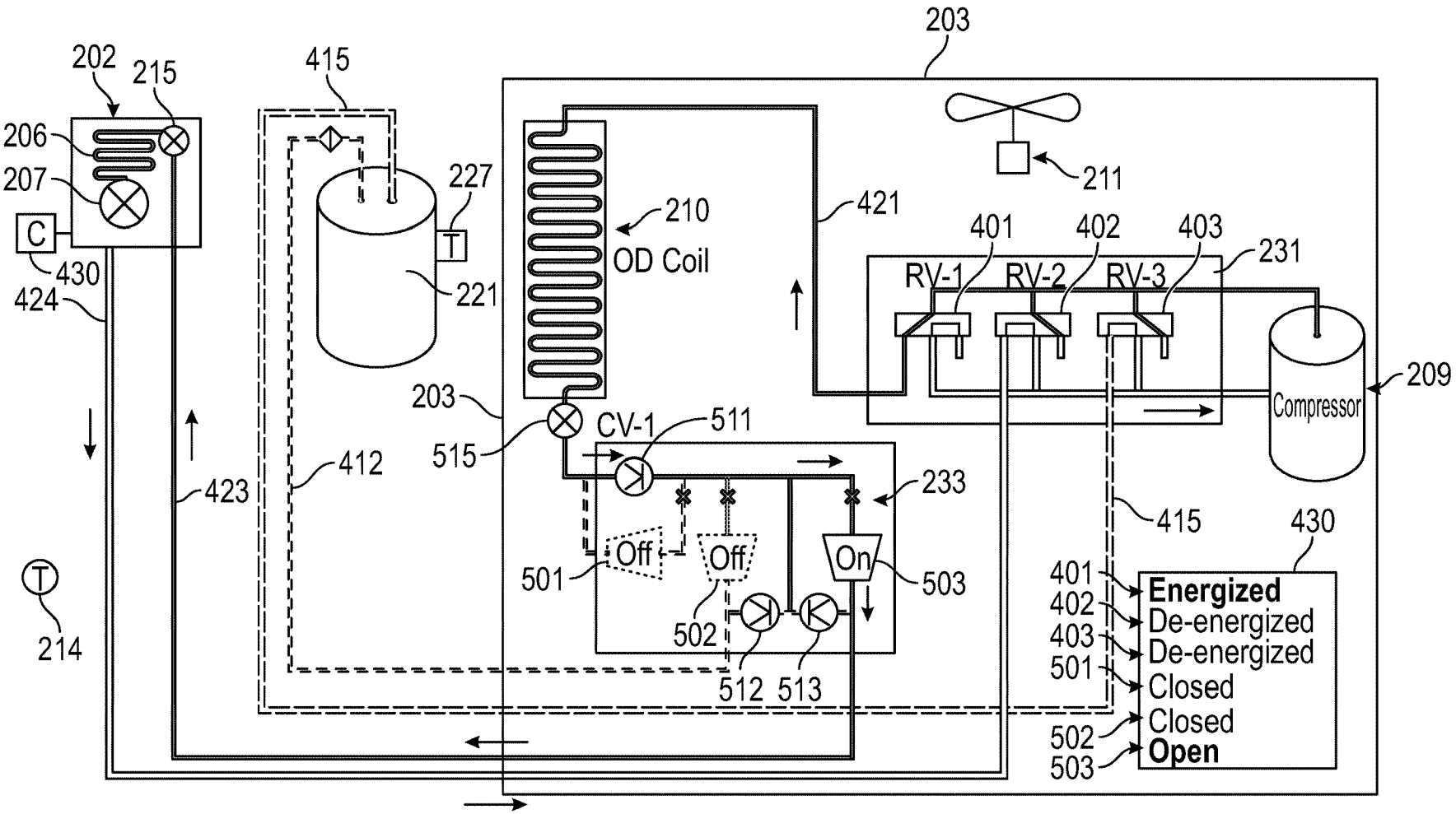
FIG. 7 is a reversing valve matrix and switch matrix arranged in a call for space cooling without a call for hot water from the Hot Tank.

FIG. 7 displays the refrigerant flow and valve operation utilized for a standard residential space cooling operation. Thermostat 214 located in a living space in the residence sends a cooling call to system controller 430, which in turn sends signals to energize the heat pump outdoor fan 211 and outdoor compressor 209. The controller also energizes reversing valve 401 and liquid line solenoid valve 503. The controller also energizes the indoor fan 207 in fancoil 202.

In this mode the compressor 209 has hot refrigerant gas directed through reversing valve 401 at pipe 421 to the outdoor coil 210, where the refrigerant is cooled into a liquid refrigerant by outdoor air, exiting coil 210 and flowing through check valve 511 and liquid line solenoid 503 to pipe 413 as a liquid line. Pipe 423 travels into the residence to the fancoil 202, entering refrigerant expansion valve 215 which reduces its pressure and temperature as it enters the coil 206. Blower 207 blows air across indoor coil 206, cooling the air with the cooled refrigerant in order to deliver cool air into the residence, preferably at about 52 degrees F.

Heat is absorbed by the cool refrigerant gas, converting it into a superheated gas which exits the fancoil 202 into refrigerant vapor line 424, which returns to the outdoor heat pump 203, where it passes through reversing valve 402 and enters the compressor 209.

Reversing valve 403, in its de-energized state allows pipe 415 from HotTank coil 321 of FIG. 3 to be connected to a suction port of compressor 209, allowing the compressor to draw down most of the trapped refrigerant in coil 321 so that it can be fully available for coil 210 in the outdoor unit and coil 206 in the fancoil 202. This cycle continues until thermostat 214 is satisfied, at which time all components are de-energized.

Figure 8:
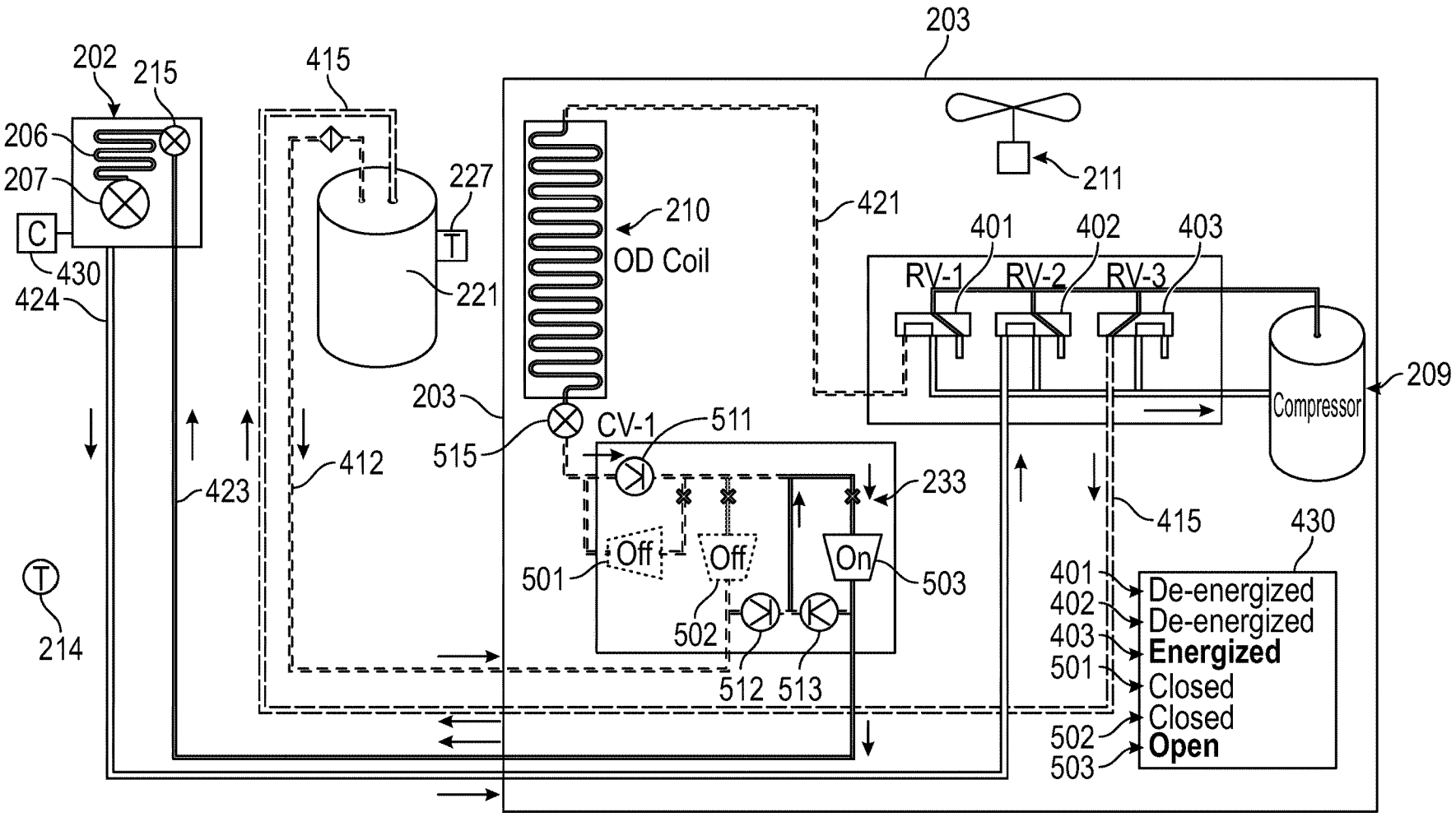
FIG. 8 is a reversing valve matrix and switch matrix arranged in a call for space cooling with a call for hot water from the Hot Tank.

FIG. 8 displays the system operation when thermostat 214 calls for residential space cooling, thermostat 227 calls for heating of the HotTank at the same time. This effectively provides both residential space cooling and hot water heating concurrently, providing essentially free domestic potable hot water, as the heat removed from the space is released into the HotTank rather than released outdoors, as was the case in the first mode of operation described above with reference to FIG. 7.

In FIG. 8, when the system controller 430 receives a call for cooling from thermostat 214 and a call for water heating from HotTank thermostat 227, the logic device of the controller will send signals to energize the heat pump outdoor fan 211 and outdoor compressor 209; energize reversing valve 403 and liquid line solenoid valve 503; energize the indoor fan 207 in fancoil 202.

In this mode the compressor 209 hot refrigerant gas is directed through reversing valve 403 at pipe 415 to the HotTank 221 coil 321 in FIG. 3, where the refrigerant is cooled into a liquid refrigerant by the water in the HotTank 221, exiting coil 321 at pipe 412 and returning to outdoor heat pump 203 and flowing through check valve 512 and liquid line solenoid 503 to pipe 423, a liquid line. This routing of the liquid bypasses outdoor coil 210 completely. Pipe 423 travels into the residence to the fancoil 202, entering refrigerant check-valve/metering device or expansion valve 215 which reduces its pressure and temperature as it enters the indoor coil 206. Blower 207 blows air across indoor coil 206, cooling the air with the cooled refrigerant in order to deliver cool air into the residence typically at about 52 degrees F.

The heat from the space is therefore absorbed by the refrigerant, vaporizing it into a superheated gas which exits the fancoil 202 into refrigerant vapor line pipe 424, which returns to the outdoor heat pump 203, where it passes through reversing valve 402 and enters the compressor 209 via a suction port.

Reversing valve 401, in its de-energized state allows pipe 421 from outdoor coil 210 to be connected to the suction port of compressor 209, allowing the compressor to draw down most of the trapped refrigerant in coil 210 so that it can be fully available to coil 321, shown in FIG. 3, in the HotTank 221 and coil 206 in the fancoil 202.

This cycle continues until either thermostat 214 is satisfied, or thermostat 227 is satisfied. If thermostat 214 satisfies first, then the system controller switches into the water heating mode described below with reference to FIG. 10. If thermostat 227 is satisfied first, then the system controller 430 reverts back to the space cooling mode described above with reference to FIG. 7.

Figure 9:
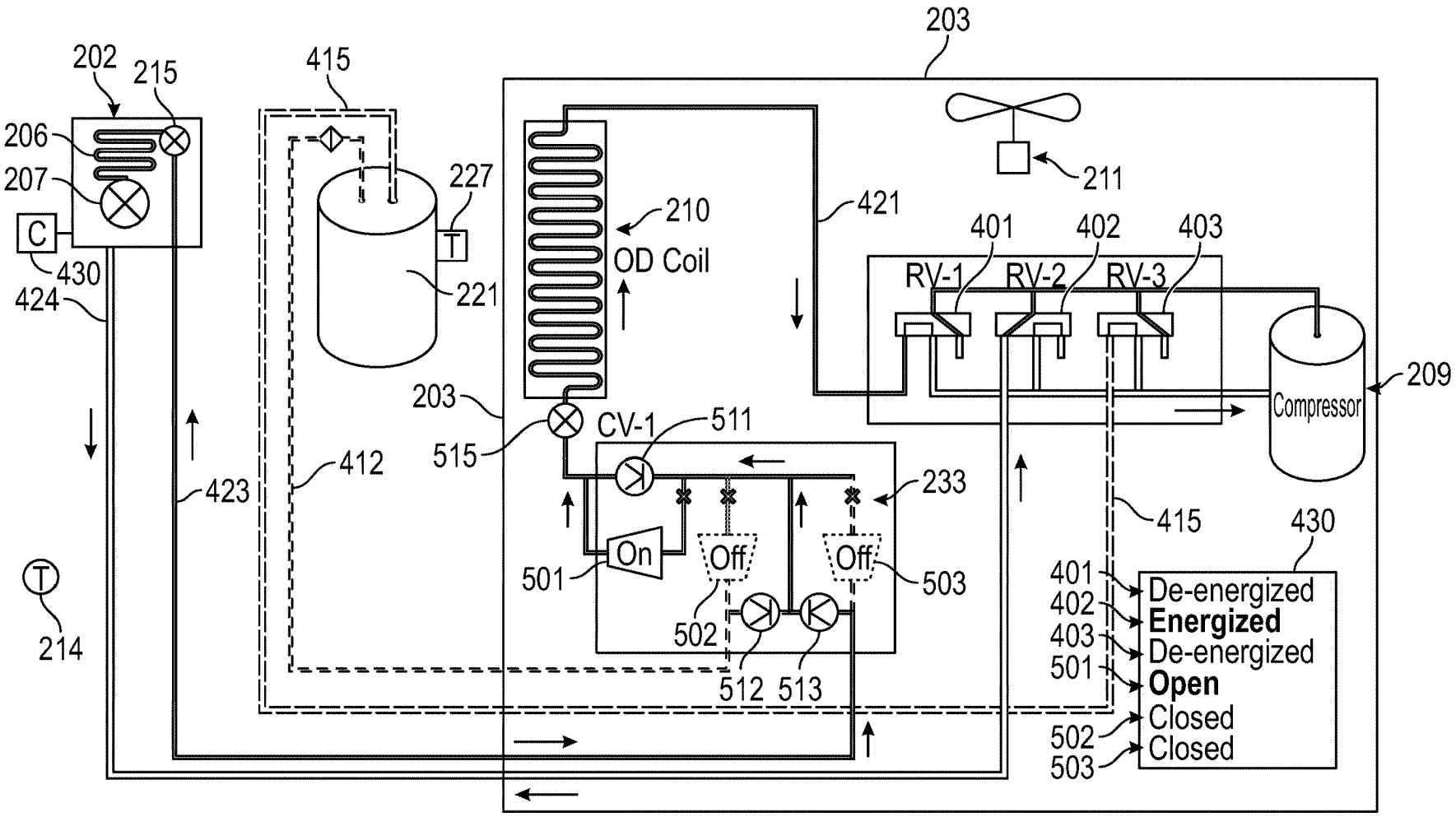
FIG. 9 is a reversing valve matrix and switch matrix arranged in a call for space heating without a call for hot water from the Hot Tank.

FIG. 9 displays the refrigerant flow and valve matrix and switch matrix operation utilized for residential standard home space heating. Thermostat 214 sends a heating call to system controller 430, which in turn sends signals to energize the heat pump outdoor fan 211 and outdoor compressor 209. The logic device of the controller further energizes reversing valve 402 and liquid line solenoid valve 501; energize the indoor fan 207 in fancoil 202.

In this mode the compressor 209 supplies hot refrigerant gas directed through reversing valve 402 at pipe 424 to the refrigerant coil 206 in fancoil 202, where the refrigerant is cooled into a liquid refrigerant by indoor air, as indoor fan 207 blows cooler indoor air across coil 206, thereby transferring heat from the refrigerant to the indoor airstream, allowing the air to exit the fancoil and into the home duct system at around 100 degrees F. The sub-cooled refrigerant exits coil 206 through pipe 423 and flows through check-valve 513 and liquid line solenoid 501 to the check-valve/metering device or expansion valve 515. Here it reduces its pressure and temperature as it enters outdoor coil 210. Blower 211 pulls air through the outdoor coil 210, allowing the cold liquid refrigerant to pick up heat from the outdoor air as it vaporizes. The superheated refrigerant vapor exits coil 210 and flows through reversing valve 401 to the compressor 209 suction inlet port where it continues the cycle back through compressor 209.

Reversing valve 403, in its de-energized state allows pipe 415 from HotTank coil 321 in FIG. 4 to be connected to the suction port of compressor 209, allowing the compressor to draw down most of the trapped refrigerant in coil 321 so that it can be fully available for coil 210 in the outdoor unit and coil 206 in the fancoil 202. This cycle continues until thermostat 214 is satisfied, at which time all components are de-energized.

Figure 10:
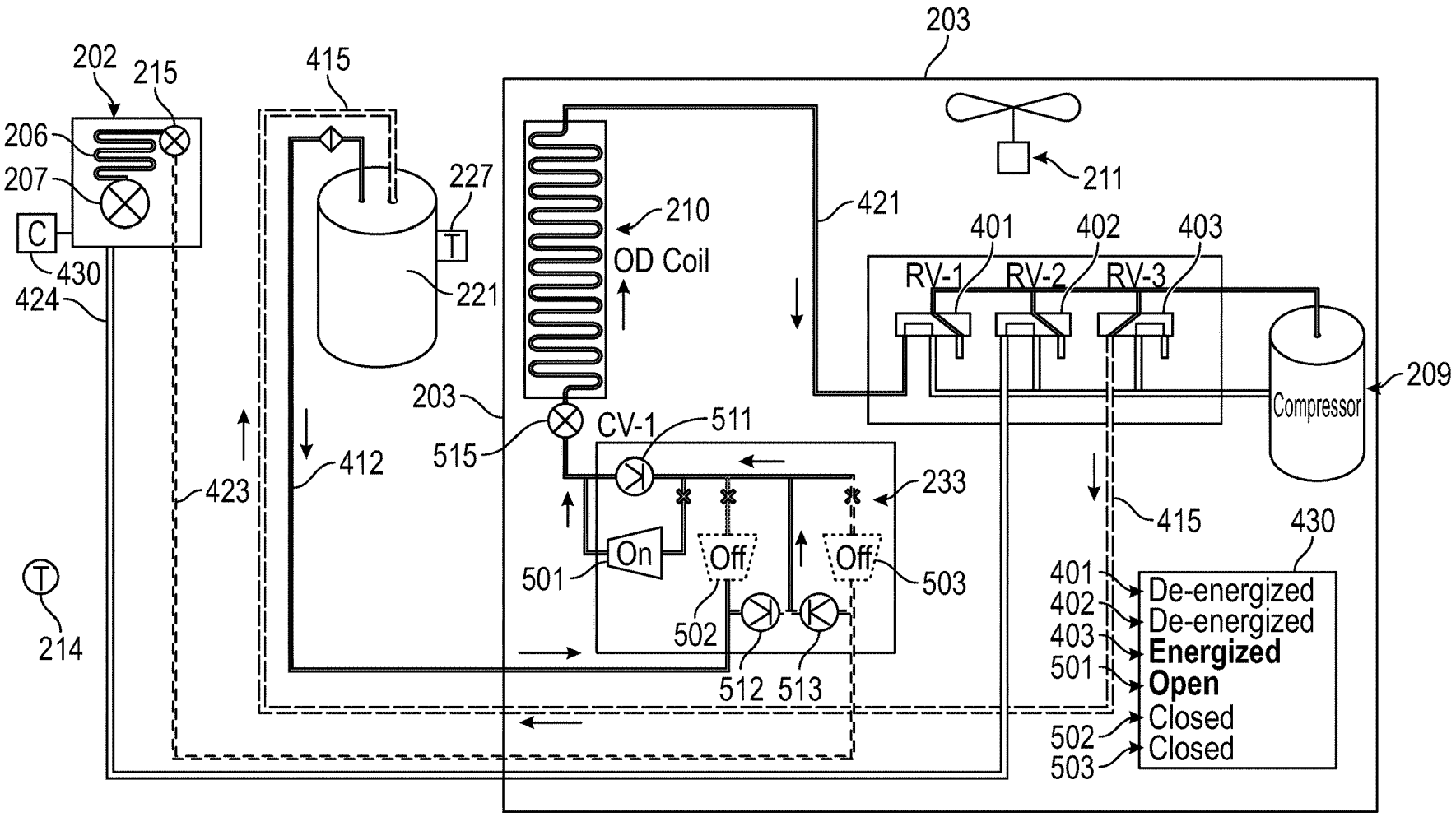
FIG. 10 is a reversing valve matrix and switch matrix arranged in a call for space heating with a call for hot water from the Hot Tank.

FIG. 10 displays the refrigerant flow and valve operation utilized for a hot water heating operation. Thermostat 227 sends a heating call to system controller 430, which in turn sends signals to energize the heat pump outdoor fan 211 and outdoor compressor 209; energize reversing valve reversing valve 403 and liquid line solenoid valve 501.

In this mode the compressor 209 supplies hot refrigerant gas directed through reversing valve 403 at pipe 415 to the refrigerant coil 321, seen in FIG. 4, in HotTank 221, where the refrigerant is cooled into a liquid refrigerant by transferring heat to the water solution in HotTank 221, raising the temperature of the water solution to 125 degrees F. or above. The sub-cooled refrigerant exits coil 321 through pipe 412 and flows through check-valve 512 and liquid line solenoid 501 to the check-valve/metering device 515 at outdoor coil 210. Here it reduces its pressure and temperature as it enters, and blower 211 pulls air through the coil, allowing the cold liquid refrigerant to pick up heat from the outdoor air as it vaporizes. The superheated refrigerant vapor exits coil 210 and flows through reversing valve 401 to the compressor 209 suction inlet port, where it continues the cycle back through compressor 209.

Reversing valve 402, in its de-energized state allows pipe 424 from coil 206 in fancoil 202 to be connected to the suction port of compressor 209, allowing the compressor to draw down most of the trapped refrigerant in coil 206 so that it can be fully available for coil 210 in the outdoor unit and coil 321 in the hot tank 221. This cycle continues until thermostat 227 is satisfied, at which time all components are de-energized.

Figure 11:
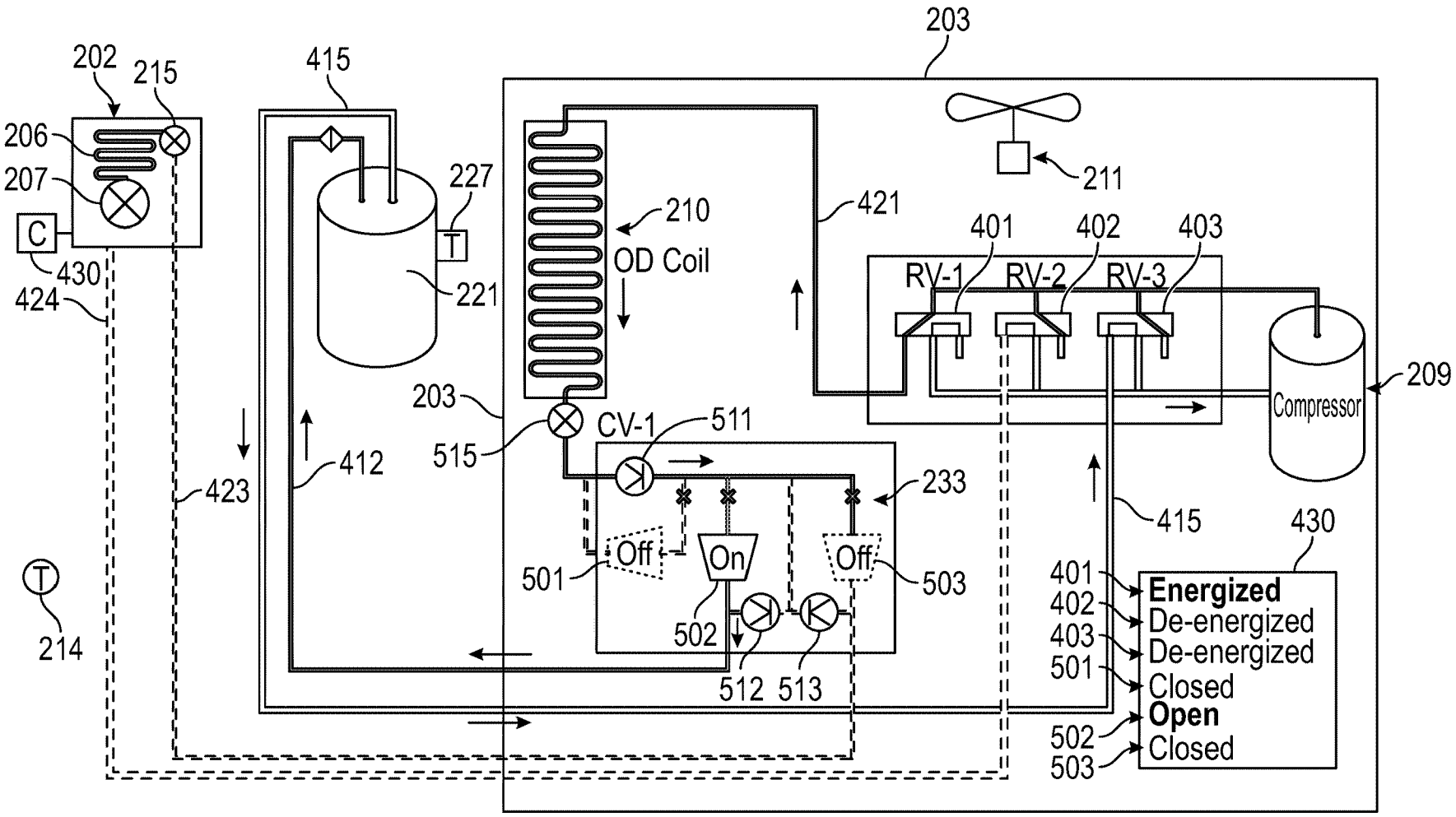
FIG. 11 is a reversing valve matrix and switch matrix arranged in a call for space heating with a call for a defrost mode of operation involving the Hot Tank.

FIG. 11 displays the refrigerant flow and valve operation utilized when the system is operating in either the space heating mode of FIG. 9 or the water heating mode of FIG. 10, and the controller initiates a defrost cycle. When outdoor temperatures are below ~50 degrees F., the outdoor coil 210 begins icing up, and over time the ice blocks the airflow from fan 211, which significantly reduces the ability of coil 210 to pick-up heat from the outdoor air. Every 90 minutes of system operation the outdoor unit defrost control will perform a temperature check of the outdoor coil 210, and if is below a prescribed level the defrost control will initiate a call for defrost, which sends signals to initiate the following: outdoor fan 211 is de-energized; system controller 430 energizes reversing valve 401 and liquid line solenoid valve 502.

In this mode the compressor 209 hot refrigerant gas is directed through reversing valve 401 at pipe 421 to the refrigerant coil 210 in outdoor unit 203, where the hot-gas quickly de-ices outdoor coil 210. usually occurring in 3 minutes or less. As the refrigerant circulates through outdoor coil 210 it is condensed into a sub-cooled liquid, exiting through check valve 511 and liquid line solenoid 502 into pipe 412 to the check-valve/metering device 515 at the refrigerant inlet of coil 321 of FIG. 4, in HotTank 221. The metering device reduces the pressure and temperature of the refrigerant to a point below the temperature of the water solution in HotTank 221, allowing the refrigerant to pick up heat from the water solution, exiting coil 321 as a superheated vapor through line 415, where it returns through reversing valve 403 to the suction inlet port of compressor 209.

Compressor 209 compresses the low-pressure low temperature vapor into a high pressure, high temperature vapor, where it flows through reversing valve 401 to pipe 421 and coil 210, delivering the superheated refrigerant necessary to de-ice coil 210, completing this circuit. This avoids the process described above, where a typical heat pump system withdraws heat from the residence through the fancoil 202, which initiates an uncomfortable cooling effect within the home. The removal of heat from the HotTank for the defrost cycle should not be noticeable to the home occupants, greatly improving the indoor comfort. Once it is recognized that the outdoor coil 210 is de-iced, the outdoor fan 211 is energized allowing the system controller to return to its previous operation mode of space heating as described in FIG. 9 or water heating as described in FIG. 10.

Mode Arbitration

A critical function of the system controller 430 is to arbitrate between the residential living space thermostat 214 and the HotTank water heater thermostat 227, as the integrated heat pump system cannot function in all modes concurrently. Below is the arbitration logic that is incorporated into the system controller 430.

1. A call for water heating is given top priority.
   a. When water heating thermostat 227 initiates a call for heating, system controller 430 will immediately switch into water heating of FIG. 10.
2. If there is a call for space cooling at the same time there is a call for water heating, because the system can provide water heating and space cooling concurrently, system controller 430 switches operation to space cooling and water heating mode as in FIG. 7, for as long as any space thermostats 14 are calling for cooling and water heating thermostat 27 is calling for water heat.
3. If thermostat 214 initiates a call for space heating, the following possible sequences occur:
   a. If there are no competing calls from any of the thermostats (specifically, no calls for cooling from space thermostat 214 or water heating from water heater thermostat 227, then system controller 430 will initiate space heating as in FIG. 9 for as long as is required to satisfy any space thermostat 214 call for space heat, for as long as there continues to be no competing calls for cooling or water heating.
   b. If there is any space thermostat 214 calling for cooling, the system controller 430 will ignore the call for space heating until the call for cooling is satisfied. When that occurs, the system controller 430 will switch into space heating as described in FIG. 9, and will remain in that operating mode until either the thermostat 214 that is calling for heat is satisfied, or until an additional call for water heating or space cooling is received by the system controller from a different thermostat than the one which is calling for space heat.
   c. If the water heater thermostat 227 is calling for water heat at the same time that a space thermostats 214 is calling for space heat, the following sequence will occur:
      i. Water heating will receive priority for a period of up to xx minutes, with xx being adjustable from 5 to 15 minutes within the system controller 430 internal settings.
      ii. If before the expiration of xx minutes the water heater thermostat 227 is satisfied, system controller 430 will switch from water heating mode as in FIG. 8 to space heating as in FIG. 9, and will remain there for at least xx minutes before allowing a new water heating call from thermostat 227 to over-ride the space heat call, or until thermostat 214 ceases to call for space heating, whichever occurs first.
      iii. If after the expiration of xx minutes the water heater thermostat 227 is still not satisfied, the system controller 430 will over-ride the water heat call and switch to a space heating mode, until either the thermostat 214 that was calling for space heat is satisfied, or until the xx minutes of space heating mode has expired, whichever occurs first.
         1. If both space and water heating thermostats continue to call for heat for a prolonged period, system controller will rotate back and forth between water heating mode and space heating mode in xx minute intervals, until such time as either space heating or water heating has been fully satisfied. System controller 430 will then operate the system in the appropriate mode until remaining call(s) for heat are satisfied.
4. The invention also allows for each space thermostat 214 to utilize any resistance heating elements that may be installed in fancoil 202, in the following manner:

Space thermostats 214 all incorporate stage 1 and stage 2 discrete heating contacts. If the system controller is operating in space heating mode as in FIG. 9, then if the thermostat 214*s* send a stage-2 heat call to the system controller 430, then the controller will initiate a call that energizes resistance heating elements in fancoil 202 for as long as a) heat mode is still the operating mode, and b) there is at least one thermostat 214 calling for stage 2 heat.

During all of these various scenarios, the system controller 430 is also properly opening and closing motorized air-duct dampers in order to align system airflow with the actual needs of a specific thermostat home zone. This feature is a standard operating function in home heating and ventilation systems. The system controller 430 also contains a feature described as "Thermal Equalizer", described in the previous patent to Wylie, incorporated by reference herein, which following a call for space heating from a specifically designated space thermostat 214, with the location of this designated space thermostat will be the lowest level floor in a multi-level home, then a call for space heating will be de-energized after a few minutes, adjustable in the system controller 430 from 5-15 minutes, but the fancoil fan 207 will continue running in order to extract trapped heat from the highest-level floor in the residence and ducted back down to the registers located in the lowest-level floor in the home, for this period of time.

What is claimed is:

1. An improved environmental control system of the type having a split system electrically powered heat pump having an outdoor compressor, an outdoor coil, an outdoor fan, an indoor coil, an indoor fan associated with ducting, an expansion valve, a living space thermostat and interconnecting piping, the outdoor coil and the indoor coil carrying refrigerant therein, comprising:

an unpressurized hot water tank storing hot water therein serving as a thermal store and having a tank thermostat therein set to a specified tank temperature range and two intertwined tank coils therein including a first tank coil carrying potable water to be heated from the thermal store and a second tank coil carrying hot refrigerant from the compressor as needed to maintain the specified tank temperature range in the stored hot water of the hot water tank, the hot water tank has an upper portion and a lower portion with the upper portion having an air-filled bladder that expands and contracts in response to water temperature in the tank;

a valve matrix having an array of reversing valves capable of communicating refrigerant fluid and vapor and further having an array of solenoid operated valves and check valves associated with the reversing valves capable of selectively communicating refrigerant fluid and vapor with any of the compressor, the outdoor coil, the indoor coil, and the second tank coil;

the living space thermostat having a desired temperature set point;

a logic device controller operatively associated with the living space thermostat and the tank thermostat, with the expansion valve, and with the valve matrix, the logic device controller programmed to direct refrigerant through selected coils, and to operate the indoor fan, the indoor coil, the outdoor fan and the outdoor coil in response to signals from the living space thermostat and the tank thermostat calling for any combination of residential heating and cooling, tank water heating, and periodic outdoor coil defrosting in at least four programmed modes of valve matrix operation including a call for tank water heating, a call for space heating, a call for space cooling, and a call for a quiescent state, the programmed modes giving top priority to calls for tank water heating, providing concurrent tank water heating and space cooling, and providing the periodic outdoor coil defrosting from the thermal store in the hot water tank, all refrigerant flow being fully diverted by the valve matrix to only selected operative coils according to each programmed mode.

2. The apparatus of claim 1 wherein ends of the intertwined first and second tank coils emerge from the hot water tank from the upper portion thereof.

3. The apparatus of claim 1 wherein the intertwined first and second tank coils are separated from each other by spacers.

4. The apparatus of claim 1 wherein the first tank coil carrying potable water is wound more tightly at a top end of the tank and less tightly at a bottom end of the tank and the second tank coil carrying refrigerant is wound in a reverse manner less tightly wound at the top end of the tank and more tightly wound at the bottom end of the tank.

5. The apparatus of claim 1 wherein water stored in the hot water tank is chemically treated for metal preservation.

6. The apparatus of claim 1 wherein the hot water tank has an outer spiral wound sheet metal skin.

7. The apparatus of claim 6 wherein the hot water tank has an inner plastic shell in contact with the stored hot water.

8. The apparatus of claim 7 wherein the hot water tank has foam insulation between the sheet metal skin and the plastic shell.

9. The apparatus of claim 1 wherein the hot water tank has a lid communicating atmospheric pressure to water in the tank.

10. The apparatus of claim 1 wherein the logic device controller includes a programmed mode of valve matrix operation that calls for both space cooling and water heating in which heat removed from indoor living space via the indoor fan and indoor coil is released into the hot water tank by refrigerant flowing through the second tank coil.

11. The apparatus of claim 1 wherein the logic device controller includes a programmed mode of valve matrix operation that calls for a defrost cycle wherein heat necessary for de-icing the outdoor coil is drawn from hot water tank by refrigerant flowing through the second tank coil via a reversing valve leading to the outdoor coil.

12. The apparatus of claim 1 wherein the logic device controller and periodically performs a temperature check of the outdoor coil to determine whether to initiate a defrost cycle.

13. The apparatus of claim 1 wherein the logic device controller in any programmed mode of valve matrix operation that calls for space heating only or space cooling only, without calling for either water heating or defrosting, provides for a refrigerant flow between indoor and outdoor coils that bypasses the hot water tank.

* * * * *